US005190084A

United States Patent [19]

Diehl et al.

[11] Patent Number: 5,190,084

[45] Date of Patent: Mar. 2, 1993

[54] FILLING ELEMENT FOR FILLING MACHINES FOR DISPENSING LIQUID

[75] Inventors: Egbert Diehl, Hackenheim; Karl Lorenz, Niederhausen; Helmut Gräff, Feilbingert; Bernd Link, Dörrebach; Ludwig Clüsserath, Bad Kreuznach; Klaus Kaiser, Neu-Bamberg, all of Fed. Rep. of Germany

[73] Assignee: Seitz Enzinger Noll Maschinebau Aktiengesellschaft, Bad Kreuznach, Fed. Rep. of Germany

[21] Appl. No.: 695,620

[22] Filed: May 3, 1991

[30] Foreign Application Priority Data

May 5, 1990 [DE] Fed. Rep. of Germany ..... 4014449
Jan. 30, 1991 [DE] Fed. Rep. of Germany ..... 4102633

[51] Int. Cl.[5] ..... B65B 3/26

[52] U.S. Cl. ..... 141/39; 141/6; 141/40; 141/83; 141/95; 141/286; 73/304 C; 73/294

[58] Field of Search ..... 141/39, 40, 83, 94, 141/95, 96, 198, 6, 165, 147, 286; 73/304 C, 294

[56] References Cited

U.S. PATENT DOCUMENTS 2,676,742 4/1954 Day et al. ..... 141/39
4,386,635 6/1983 Ahlers et al. ..... 141/6
4,467,646 8/1984 Berryman et al. ..... 73/304 C
4,506,709 3/1985 Donnhardt ..... 141/95
4,509,565 4/1985 Ahlers ..... 141/39
4,530,384 7/1985 Boyes ..... 141/95
4,644,981 2/1987 Bernhard ..... 141/39
4,787,427 11/1988 Bacroix et al. ..... 141/39
4,787,428 11/1988 Bacroix et al. ..... 141/39
4,806,847 2/1989 Atherton et al. ..... 73/304 C

FOREIGN PATENT DOCUMENTS 3909398 11/1989 Fed. Rep. of Germany .

*Primary Examiner*—Ernest G. Cusick
*Attorney, Agent, or Firm*—Robert W. Becker & Associates

[57] ABSTRACT

A filling element for filling machines is provided and includes a liquid flow valve, which comprises a valve body that can be moved back and forth in a filling element axis between a position that closes the liquid flow valve off and a position that opens this valve. Also provided is an electrical probe for determining filling heights of liquid material in containers. The probe includes a first probe element that projects beyond the underside of the filling element and has an electrode, and a second probe element that at least partially surrounds at least part of the first probe element. The lower end of the second probe element is spaced further from the underside of the filling element than is the first probe element.

16 Claims, 6 Drawing Sheets

FILLING ELEMENT FOR FILLING MACHINES FOR DISPENSING LIQUID

BACKGROUND OF THE INVENTION

The present invention relates to a filling element for filling machines for dispensing a liquid material into bottles, cans, or similar containers, including: a liquid flow valve that is disposed in liquid passage means of the filling element and has a valve body that cooperates with a valve seat of the filling element and can be moved back and forth between a position that closes the liquid flow valve off and a position that opens the liquid flow valve: and a discharge opening that is provided on an underside of the filling element and via which when the liquid flow valve is opened the liquid material flows to a respective container that is to be filled.

A number of embodiments of filling elements for filling machines for dispensing a liquid material into bottles, cans, or similar containers are known. In addition, filling elements are known that have a return gas tube that forms a gas channel and is surrounded by the discharge opening, with the return gas tube extending downwardly beyond the discharge opening of the filling element; the valve body as well as an umbrella-shaped deflector means are provided on the return gas tube, whereby to open and close the liquid flow valve, the return gas tube, together with the valve body and the deflector means, can be moved back and forth in the direction of the filling element axis (DE-OS 39 09 398). With this known filling element, not only in the closed position but also in the opened position of the liquid flow valve, the umbrella-shaped deflector means is disposed in a portion of the liquid passage means that is disposed downstream of the liquid flow valve when viewed in the direction of flow of the liquid material; this deflector means, in conjunction with a cross-section of this portion of the liquid passage means that widens conically in a direction toward the discharge opening, serves essentially to impart to the liquid filling material, when the liquid flow valve is opened, a radially outwardly directed flow component, so that after entering the container that is to be filled, the liquid material flows down along the inner surface of the wall of this container.

Unfortunately, a problem with the known filling elements of this type is that, among other things, filling material residue enters the gas channel and thereby obstructs the flow of return gas through this channel. This leads to a considerable reduction in the filling velocity, i.e. the speed at which the liquid material rises in the respective container, and hence to a considerable reduction of the efficiency of a filling machine (measured as number of containers filled per unit of time).

In addition, to ensure a prescribed filling height, the respective filling machine cannot be operated at maximum capacity if obstruction or clogging of the gas channels in the return gas tubes is anticipated.

It is therefore an object of the present invention to provide a filling element that considerably improves the efficiency of a filling machine.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
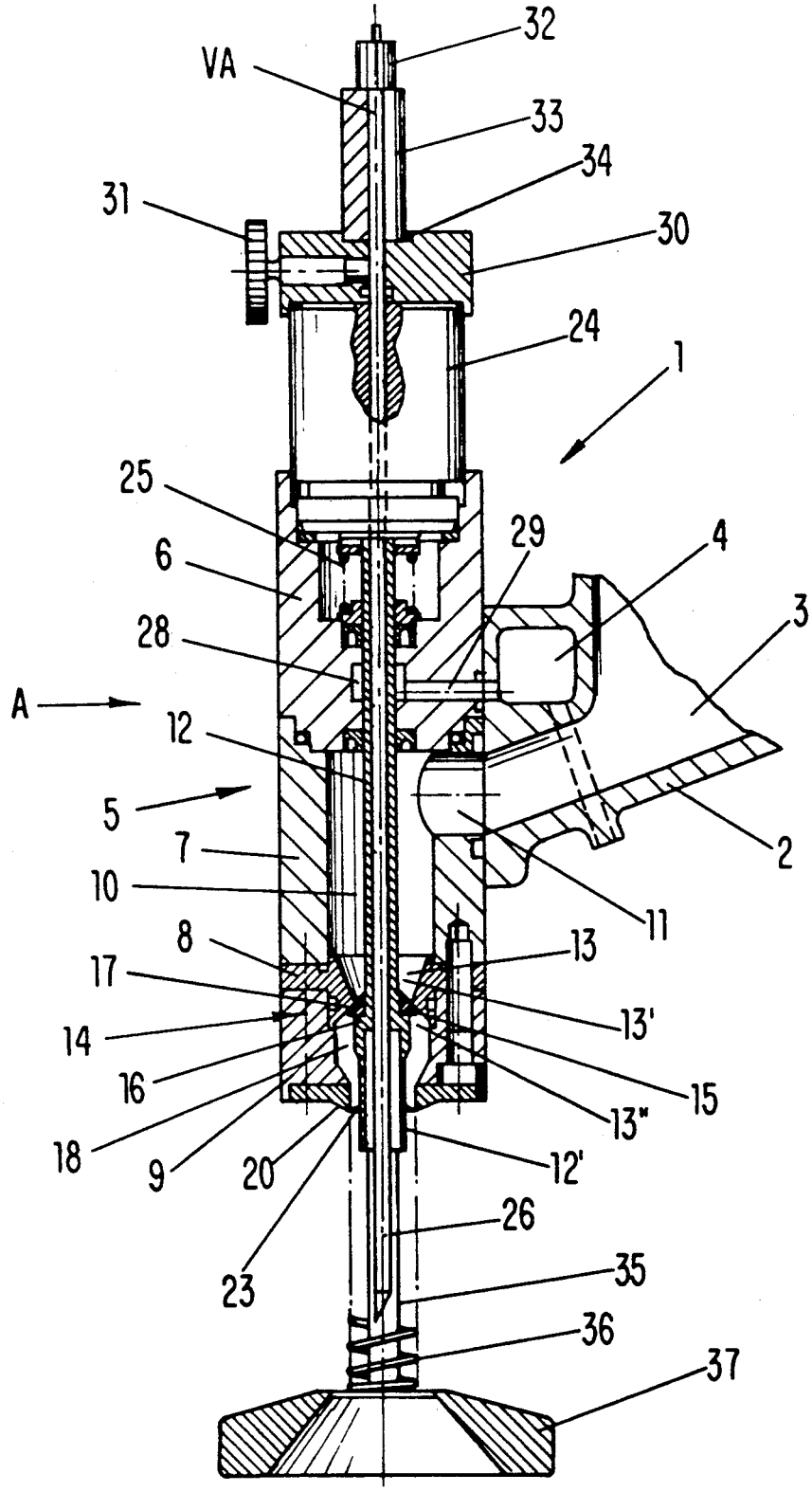
FIG. 1 is a cross-sectional view of a first exemplary embodiment of the inventive filling element, together with a portion of that part of a filling machine that carries this filling element.

Pursuant to one specific embodiment of the present invention, the filling element further comprises: a return gas tube that is concentric to the filling element axis, in which the valve body is moved, and is surrounded by the discharge opening of the filling element, with the return gas tube having a lower portion that extends beyond the underside of the filling element, and with a gas channel for a return gas stream being formed in the return gas tube and opening out at the lower tube portion, with the gas channel having a cross-sectional area, at least in the lower tube portion, such that a flow velocity of return gas therein is reduced to such an extent that none of the liquid material is carried along therewith; and an umbrella-shaped deflector means that is moved along with the valve body during opening and closing of the liquid flow valve, with the deflector means being disposed downstream of the liquid flow valve when viewed in the direction of flow of the liquid material, whereby to open the liquid flow valve, the valve body is movable in a direction toward the underside of the filling element with the deflector means, in the closed position of the liquid flow valve, closing off the discharge opening at least to such an extent that none of the liquid material can escape through the discharge opening.

Pursuant to a further specific embodiment of the present invention, the filling element further comprises: a gas channel that at the underside of the filling element is open at a return gas opening for a return gas stream, whereby in this region the gas channel is concentric to a filling element axis and is surrounded by the discharge opening of the filling element; and an electrical probe for determining filling heights of the liquid material in the containers, with the probe including: a first probe element, which projects beyond the underside of the filling element and has at least one portion that is provided with at least one electrode that forms a probe contact and is associated with a further probe contact; and a second probe element that is provided on the filling element, extends in the direction of the axis thereof, and at least partially surrounds the at least one portion of the first probe element, with a lower end of the second probe element being spaced further from the underside of the filling element than is the at least one portion of the first probe element, and with the second probe element not only being axially open at the lower end thereof but also being radially open in at least one side portion thereof.

The present invention is based upon, among other things, the recognition that the filling material residue that obstructs the return gas flow is formed by such filling material, which at start-up reaches the return gas opening, or after termination of a filling process, with the liquid flow valve closed, remains in that portion of the liquid flow path that, when viewed in the direction of flow of the filling material, adjoins the liquid flow valve, and that this filling material residue, prior to the initiation of a further filling process, flows downwardly at the return gas tube and reaches the region of the return gas opening that is located there.

Based upon this recognition, it is proposed pursuant to a first aspect of the present invention to move the valve body, and hence also the deflector means therewith, downwardly in the direction of the filling element axis in order to open the liquid flow valve. In so doing, it is possible to use the deflector means in order to close off the discharge opening, when the liquid flow valve is closed, at least to such an extent that with the liquid flow valve closed no liquid material residue can any longer flow out of the discharge opening. However, in order to also be able to prevent filling material residue that might be adhering to that portion of the return gas tube that projects beyond the discharge opening from being carried along with the return gas or air into the gas channel during the next filling process, this gas channel, starting from the return gas opening, has at least a portion of the length thereof provided with an increased cross-sectional area, so that as a result the flow velocity of the return air or gas is reduced to such an extent that filling material residue that might be present is not carried along. The gas channel preferably has a reduced cross-sectional area beyond this partial length, so that to achieve as large a cross-sectional area as possible for the liquid passage means that surrounds the return gas tube, especially in the region of the liquid flow valve, the outer cross-sectional area of the return gas tube, i.e. of a tubular member that forms this tube can be kept as small as possible.

Pursuant to one preferred specific embodiment of the present invention, the effective flow cross-section of a gas path that connects the gas channel in the return gas tube with a return gas channel of the filling machine can be controlled, and in particular in such a way that at least when the filling machine is stopped, at all of the filling elements of this machine a reduction of the affective flow cross-section of the gas path is automatically effected. This control of the flow cross-section of the gas paths of the filling elements can also be utilized regardless of the specific configuration of the filling element with regard to the liquid flow valve and the umbrella-shaped deflector means.

Pursuant to a second aspect of the present invention, a probe that determines the filling heights is provided and comprises an inner, first probe element and an outer, second probe element that at least partially surrounds the first probe element, or an active probe zone thereof, in order in this way to achieve an exact and non-problematic operation of the probe.

Further specific features of the present invention will be described in detail subsequently.

DESCRIPTION OF PREFERRED EMBODIMENT

Referring now to the drawings in detail, FIG. 1 shows a filling element 1 that is characterized by a particularly economical and sturdy construction. With container or bottle filling machines, generally a number of identical filling elements 1 are secured to the periphery of a part 2 of a bottle filling machine rotor that rotates about a vertical axis. The part 2 forms a reservoir 3 or distribution channel for the liquid material that is to be dispensed; the part 2 also forms a return gas channel 4.

The filling element 1 includes a housing 5 that is secured to the part 2. This housing 5 comprises a housing part 6, a housing part 7, an insert 8, and the housing part 9, whereby when viewed in a vertical direction, i.e. in the direction of the filling element axis VA, these components adjoin one another in the aforementioned sequence, and in particular are tightly connected to one another using appropriate sealing rings.

Formed in the housing part 7 is an annular liquid passage 10 that communicates with the reservoir 3 via an opening 11. The liquid passage 10 surrounds a tubular element or return gas tube 12 that is disposed coaxial with the filling element axis VA. The upper end of the liquid passage 10 is closed off by the housing part 6. In a lower portion 13', which tapers downwardly in a frusto-conical manner, the liquid passage 10 forms an opening 13 that is formed in the insert 8 and concentrically surrounds the filling element axis VA. The opening 13 extends to the region of a liquid flow valve 14, i.e. a valve seat 15 for the valve body 16 or the sealing means 17 of the liquid flow valve 14 that is disposed at that location. The valve seat 15 is formed by a portion of the inner surface of a portion 13'' of the opening 13, with this portion 13'' conically widening in a downward direction and adjoining the bottom of the portion 13' when viewed in the vertical direction. In particular, the valve seat 15 is disposed in the vicinity of the transition between the portions 13' and 13''.

The valve body 16 is provided on the return gas tube 12, which, however, extends downwardly beyond the valve body in the direction of the filling element axis VA, and in particular via a tube portion 12' that is open at its bottom end; the inner and outer cross-sectional areas of the tube portion 12' are greater than those of the rest of the return gas tube 12.

Formed below the liquid flow valve 14, in the housing part 9, is an annular passage 18 that surrounds both the valve body 16 and the tube portion 12' and at the underside of the housing part 9 forms a discharge opening 19 for the filling element 1. In the vicinity of this discharge opening 19, at the underside of the filling element 1, a sealing means 20 is provided against which the mouth 22 of a bottle 21 that is to be filled is respectively pressed in a known manner, at least during the filling phase; in particular the mouth 22 of the bottle is pressed against a frusto-conical portion 20' of the sealing means 20 that extends downwardly and surrounds the discharge opening 19. Secured to the outer surface of the tube portion 12' is an umbrella-like deflector means 23 that, when the liquid flow valve 14 is closed, is disposed in or against the discharge opening 19 and thereby closes off the annular passage 18 in the vicinity of the discharge opening 19. To open the liquid flow valve 14 the return gas tube 12, the upper end of which is sealingly passed through the housing part 6, is movable in a downward direction by a prescribed distance in the direction of the filling element axis VA via an electrical actuating mechanism 24, i.e. via a magnet, against the action of a compression spring 25. As a result of such downward movement, the sealing means 17 is lifted from the valve seat 15, and at the same time the deflector means 23 is also removed from the sealing means 20. Not only when the liquid flow valve 14 is opened, but also when it is closed, the bottom end of the return gas tube 12 formed at the tube portion 12' extends beyond the underside of the filling element 1 i.e. beyond the sealing means 20 that is located there.

A rod-like probe 26 is disposed in the return gas tube 12 as an element for determining the filling height. The bottom end of the probe 26 projects beyond the bottom end of the return gas tube 12, i.e. the portion 12' thereof, and the upper end of the probe 26 projects beyond the top of the filling element 1. Since the rod-like probe 26 has a circular cross-section that is less than the inner cross-section of not only the tube portion 12' but also the rest of the return gas tube 12, a gas channel 27 (FIG. 2) that surrounds the probe 26 is formed within the return gas tube 12. This gas channel 27 extends into the region of the housing part 6, i.e. to a chamber 28 thereof that surrounds the return gas tube 12 and with which the gas channel 27 communicates via at least one opening that is provided in the wall of the return gas tube 12. Above the chamber 28, when viewed in the vertical direction, the gas channel 27 is closed off by the probe 26, as well as by non-illustrated sealing means, and in particular in such a way that with the probe 26 remaining stationary in the direction of the filling element axis VA, the return gas tube 12 can be axially moved in the manner described for opening and closing the liquid flow valve 14. The chamber 28 communicates with the return gas channel 4 via a channel 29.

Secured to the upper side of the actuating mechanism 24 is a clamping element 30 through which the probe 26 is guided and in which the probe can be secured in place with the aid of a setscrew or knurled-head screw 31. The top of the probe 26 is provided with a head or grip element 32 that has a larger cross section and from which the electrical connection for the probe 26 is guided. Disposed between the grip element 32 and the upper side of the clamping element 30 is a spacer 33 that in the illustrated embodiment, in a section plane that is perpendicular to FIG. 1, has an essentially U-shaped cross-sectional profile, and via two legs as well as a portion of the profile that connects these legs extends in a clamp-like manner about an end of the probe 26 that projects beyond the upper side of the clamping element 30. As a consequence of embodying the spacer 33 as a length of an U-profile, it is possible, when the setscrew 31 is loosened and the probe 26 is raised slightly, to laterally place the spacer 33 upon the probe 26 and to then subsequently lower the probe to such an extent that the grip element 32 rests against the upper end of the spacer 33 and the bottom end of the spacer rests upon the clamping element 30. Thus, as a consequence of the length of the spacer 33, the position of the probe 26 in relation to the filling element 1, i.e. the underside thereof, can be exactly established. To prevent loss of the spacer 33, when the setscrew 31 is tightened, the spacer 33 is not only clamped between the grip element 32 and the clamping element 30, but in addition the bottom end of the spacer extends into a recessed portion 34 of the clamping element 30. A centering tulip or bell 37 is displaceably provided on the housing 5 of the filling element 1 via two guide rods 35, with the centering bell being displaceable in a customary manner in the direction of the filling element axis VA against the action of two compression springs 36. In particular, the centering bell 37 can be shifted between a position in which the centering bell is disposed below the bottom end of the probe 26 and a position in which the centering bell 37 rests against the underside of the filling element 1.

The general manner of operation of the filling element 1, which in the described form is intended for filling bottles 21 at atmospheric pressure, corresponds to conventional filling elements; in other words, after the respective bottle 21 has been pressed against the sealing means 20, the liquid flow valve 14 is opened so that the liquid material can flow to the bottle 21 via the discharge opening 19. The gas or air that is displaced by the incoming material is withdrawn in a known manner via the gas channel 27, the chamber 28, the channel 29, and the return gas channel 4.

Regardless of special embodiments, the filling element 1 has the following combination of features:

To open the liquid flow valve 14, the valve body 16, and therewith the deflector means 23, are moved downwardly.

When the liquid flow valve 14 is closed, the deflector means 23 closes off the discharge opening 19.

As a consequence of the tube portion 12' with the larger inner cross-sectional area, the lower portion of the gas channel 27, i.e. at the return gas opening thereof, has an enlarged flow section.

The aforementioned combination of features provides a considerable advantage, i.e. as a result of the combination of the aforementioned features residue or drops of filling material are effectively prevented from entering the gas channel 27 and possibly closing-off the same, which would at least prolong the time necessary for the filling process and hence would reduce the efficiency of the filling machine. The umbrella-like deflector means 23 primarily prevents the liquid material from flowing downwardly directly on the outer surface of the tube portion 12' and hence possibly entering the opening of the gas channel 27. Due to the fact that the lower portion of the gas channel 27, i.e. in the tube portion 12', has an increased flow cross-section, a greatly reduced flow velocity is present at this location for the air or gas that is displaced during the filling process, so that also for this reason even such quantities of liquid material that have reached the bottom end of the return gas tube 12 despite the presence of the deflector means 23 cannot be carried along into the gas channel 27. Due to the fact that the liquid flow valve 14 is opened in a downward direction by moving the valve body 16, it is also possible to simultaneously use the deflector means 23 to close off the discharge opening 19 during closing of the liquid flow valve 14 at least to such an extent that when the liquid flow valve 14 is closed, residual filling material that is present in the annular passage 18 cannot escape downwardly out of the discharge opening 19 and possibly pass the deflector means 23 and enter the bottom, open end of the tube portion 12' or the gas channel 27 in order to then possibly be carried along into the gas channel 27 during the next filling process.

Thus, with the aforementioned combination of features, while having a straightforward construction an extremely effective protection against carrying liquid into the gas channel 27 is achieved. This also means that the gas channel 27 is completely open for the air or gas that has been displaced from the bottle 21 that is being filled, so that the respective filling process can be carried out completely in a short period of time, thereby achieving a high efficiency for the filling machine. This efficiency is also enhanced in that the connecting paths for the liquid material provided in the filling element 1, and hence in particular the liquid passage 10 and the opening 11 to the reservoir 3, have a large cross-sectional area. This is possible because, among other things, the gas channel 27 extends into the housing part 6, i.e. into a region above the liquid passage 10 and the connection to the reservoir 3. However, this means a relatively great length for the gas channel 27 which despite the desired high efficiency for the filling machine is possible due to the fact that a carrying-along of residual filling material into the gas channel 27 is effectively prevented in the aforementioned manner.

Figure 2:
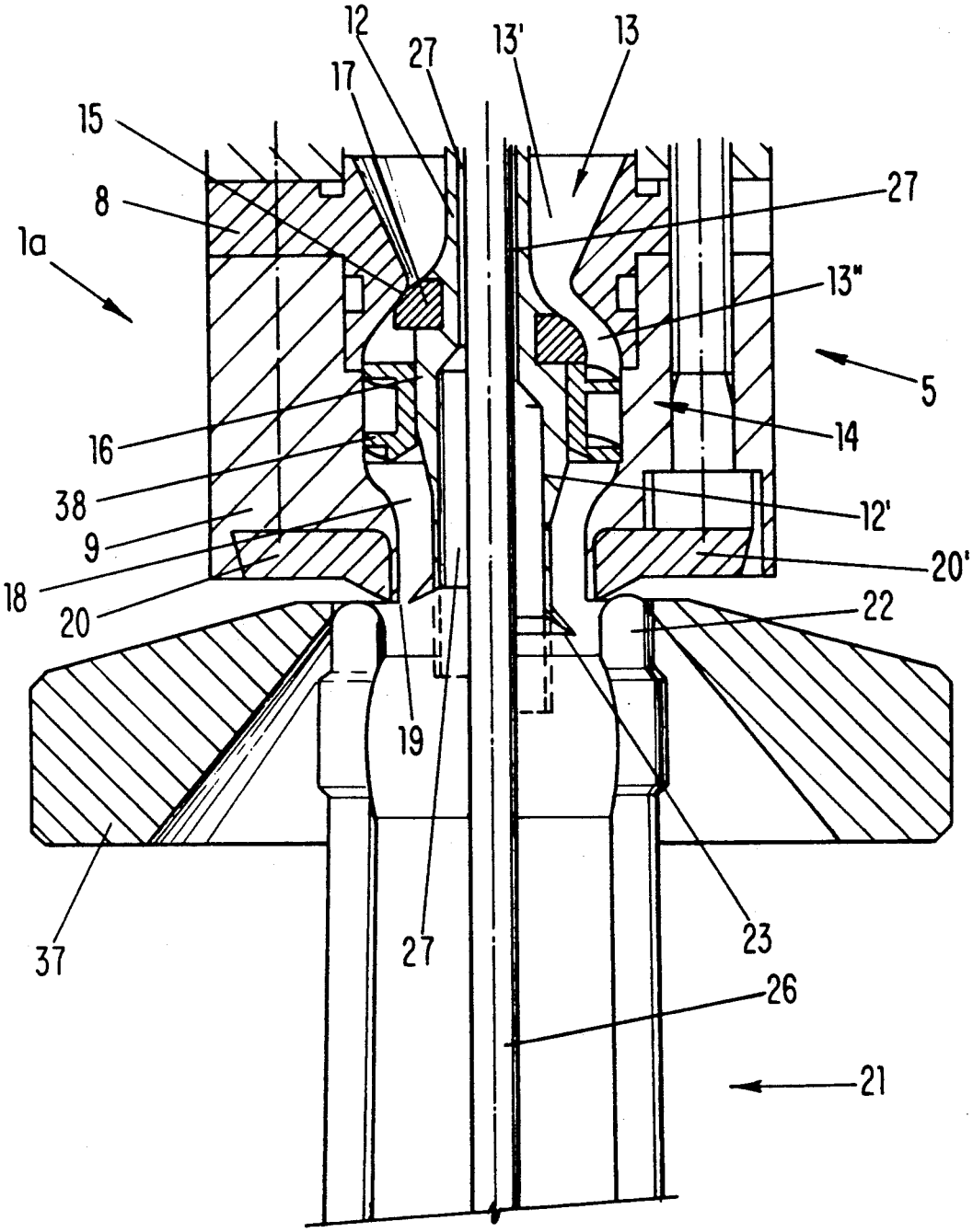
FIG. 2 is an enlarged detailed view of the region of the liquid flow valve, together with a channel for the liquid material that extends between the liquid flow valve and the discharge opening, and also shows the upper end of a bottle that is to be filled.

FIG. 2 shows a filling element 1*a* that differs from the filling element 1 essentially only in that in the connecting or liquid path between the liquid flow valve 14 and the discharge opening 19, a member 38 is disposed that, when the liquid flow valve 14 is opened, at least in a portion of the aforementioned connecting path, imparts to the liquid material a flow path that helically surrounds the filling element axis VA, i.e. imparts a swirl to this material, so that even after passing the discharge opening 19, the liquid material flows downwardly essentially only along the inner surface of the bottle 21.

Figure 3:
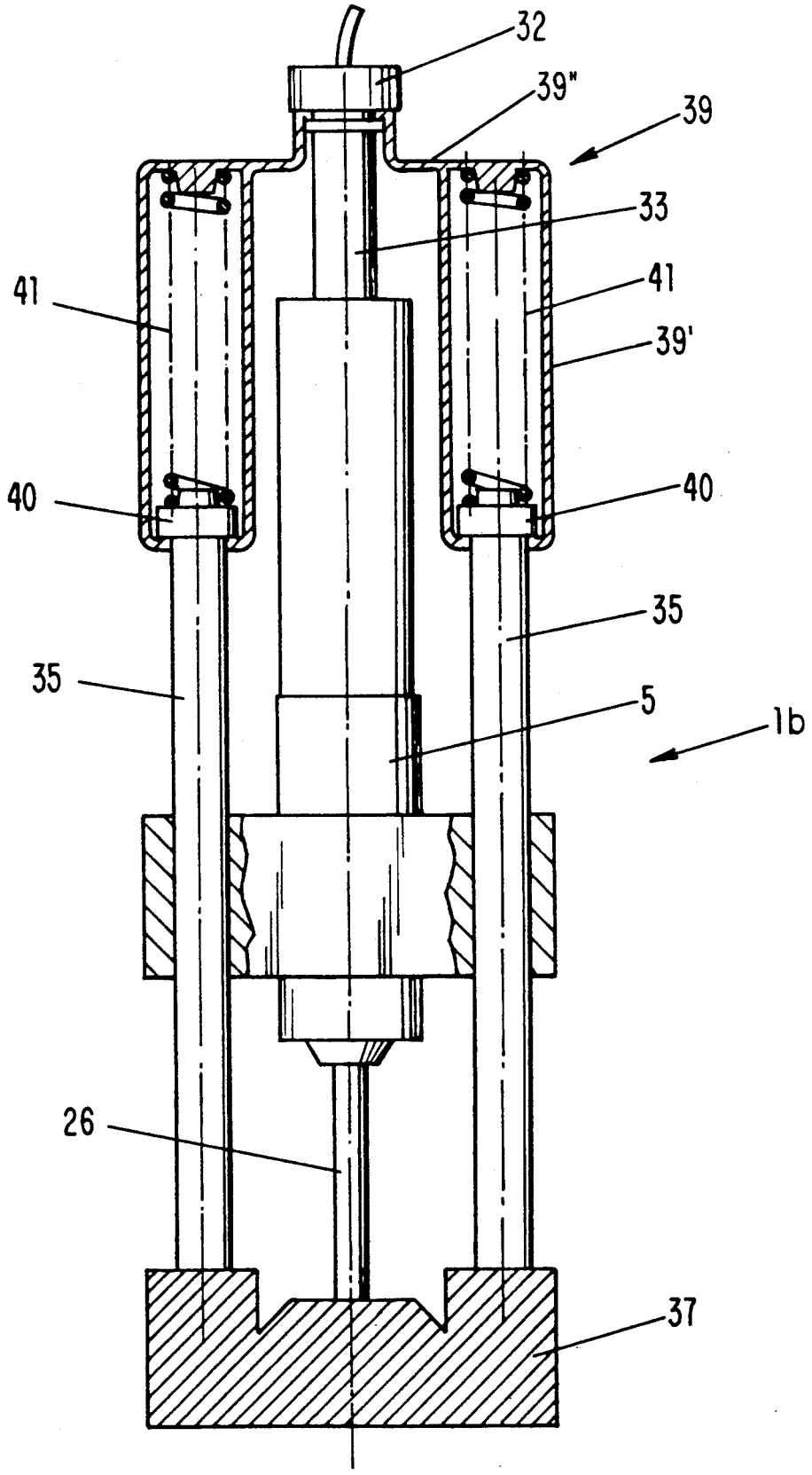
FIG. 3 is a side view of a further exemplary embodiment of the inventive filling element and is taken at 90° relative to the view of FIG. 1, i.e. is a view taken in the direction of the arrow A of FIG. 1.

FIG. 3 shows an embodiment where the guide rods 35 for the centering bell 37 are guided in a yoke or bracket 39 against which the upper ends of the guide rods 35 rest via respective stop means 40 when the centering bell 37 is lowered. In the illustrated embodiment, the stop means 40, which are respectively embodied as collars and project radially beyond the peripheral surface of the pertaining guide rods 35, are guided in a cylindrical housing or portion 39' of the bracket 39, with the axis of this portion 39' being coaxial with the axis of the pertaining guide rod 35. In place of the compression springs 36, a compression spring 41 is provided in each portion 39'. A bracket portion 39'' connects the portions 39', which project downwardly from the portion 39''. The bracket 39 is secured to the upper end of the probe 26 via the portion 39'' to thereby form with this embodiment a grip element that corresponds to the grip element 32.

The particular advantage of the filling element 1*b* is that during adjustment of the position of the probe 26 via spacers 33 of various lengths, the bracket 39 and hence the lower end position of the centering bell 37 are also adjusted therewith in the vertical direction, so that regardless of the positioning of the probe 26, in its lower position the centering bell 37 is respectively disposed below the bottom end of the probe 26 at a prescribed distance that remains constant. In this way, an excessively large vertical lifting of the bottles 21 both at the beginning as well as at the end of the filling process is avoided, and hence a considerable increase of the filling angle during rotation of the filling machine and thus ultimately a considerable increase of the efficiency of the filling machine are achieved.

Figure 4:
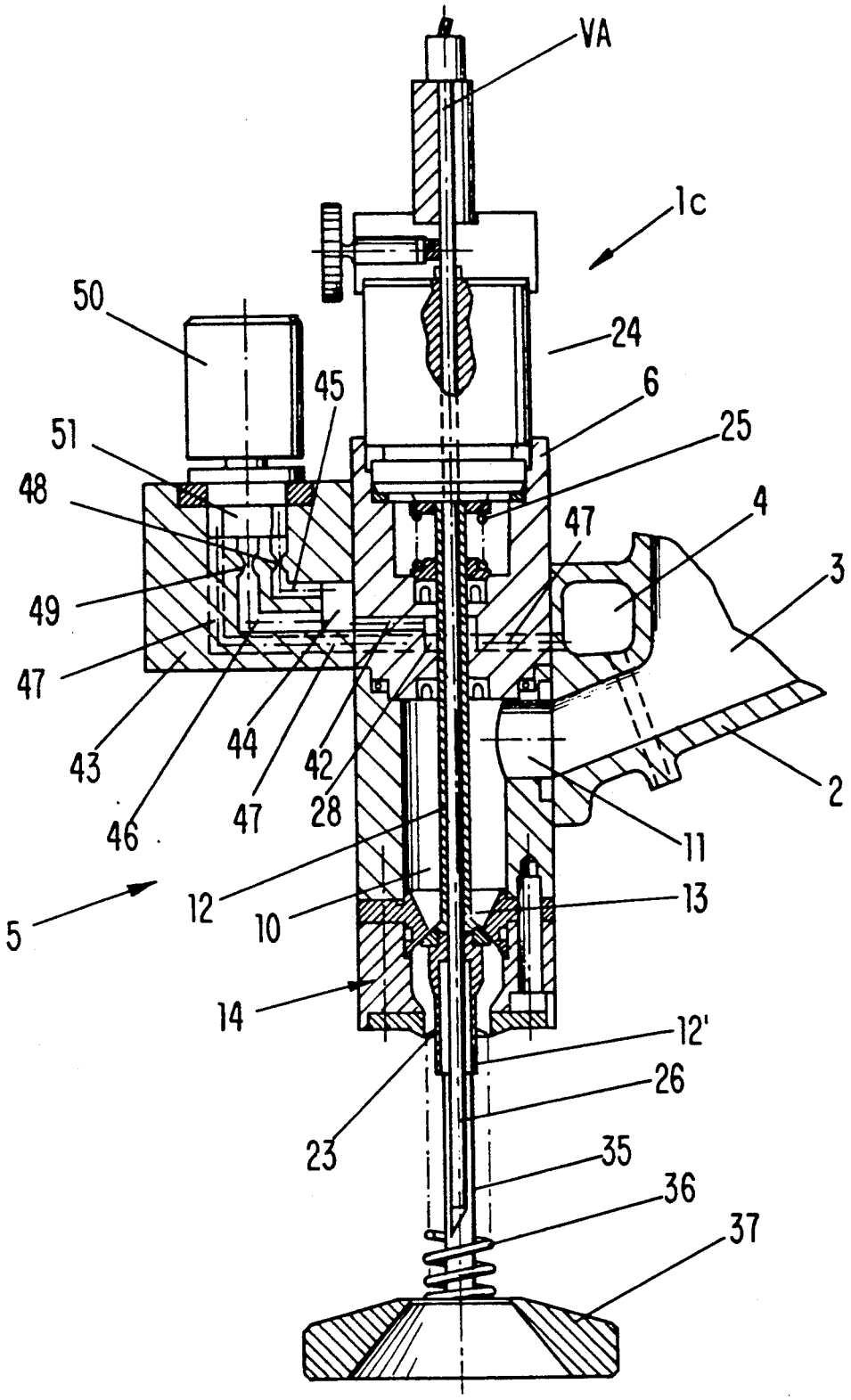
FIG. 4 is a modification of the filling element of FIG. 1.

FIG. 4 shows a filling element 1*c* that differs from the filling element 1 of FIG. 1 only in that the gas path from the chamber 28 to the return gas channel 4 can be controlled with regard to the effective flow cross-section thereof. For this purpose, rather than communicating with the channel 29, the chamber 28 communicates with a channel 42 that is formed in the housing part 6 and opens into a chamber 44 that is formed on a control block 43. At this chamber 44, the gas path splits into two parallel channels 45 and 46 that are formed in the control block 43; these channels 45 and 46 finally open in the control block 43 into a common channel 47 that is formed partially in the control block and partially in the housing part 6 and that leads to the return gas channel 4. Provided in the channel 45 is a restrictor or flow control zone 48 via which the channel 45 has an effective flow cross-section that is considerably less than that of the channel 46. Although in the embodiment of the filling element 1*c* illustrated in FIG. 4 the channel 46 also has a restrictor or flow control zone 49, the diameter of this flow control zone is considerably greater than the passage of the flow control zone 48. Furthermore provided on the control block 43 is a valve 51 that is actuated by an actuating mechanism 50, i.e. by a magnet. As a function of activation of the actuating mechanism 50, the valve 51 opens and closes the channel 46, so that when the valve 51 is closed, the return gas path leads exclusively through the channel 45 which is provided with the flow control zone 48, and when the valve 51 is open, the return gas path is formed by both of the channels 45 and 46, and in fact is formed mainly by the channel 46. With the aid of the control block 43 and the elements provided there, it is thus possible to control the return gas path in such a way that at the beginning of the process of filling a bottle 21, by opening the channel 46 a rapid filling phase is effected during which the liquid material flows to the bottle 21 at a great speed, so that the rate at which the material rises in the bottle 21 is also great. After this rapid filling phase, for example via time advance, control by a sensor, etc, a slow filling phase at reduced speed is initiated, and in particular prior to the time that the liquid material that is rising in the bottle 21 reaches the narrow neck of the bottle. Initiation of this slow filling phase is effected by closing the valve 51, i.e. the channel 46, via the actuating mechanism 50, so that the air or gas that has been displaced by the liquid material in the bottle 21 can now not escape as fast, and hence the liquid material can also not rise as rapidly.

During normal operation of the bottle filling machine, the actuating mechanisms 50 of all of the filling elements 1*c* are individually controlled in the manner described above. When the filling machine has stopped, the actuating mechanisms 50 of all of the filling elements 1*c* are triggered for closing the respective channel 46, with the advantage that even when the bottle filling machine is stopped, all of the bottles 21, and in particular the last bottles 21 that have entered the process prior to the time that the filling machine was stopped, are satisfactorily filled in a careful manner. This would not be ensured if the aforementioned central control of the actuating mechanism 50 were not present, since with the bottle filling machine stopped and with the bottles 21 becoming increasingly full, the flow speed as well as the volume of the flow of the liquid material to the bottles 21 that have entered last increase The result is that the filling height at which the probe 26 effects a closing of the liquid flow valve 14 is reached considerably earlier than occurs when the bottle filling machine is running; in other words, the slow filling phase is in fact no longer effective.

The careful filling via the rapid filling phase and the subsequent slow filling phase not only brings about a constant, exact filling height, but rather above all also prevents the liquid material from forming bubbles and thus significantly contributes to the prevention of residual filling material from entering the gas channel 27.

Figure 5:
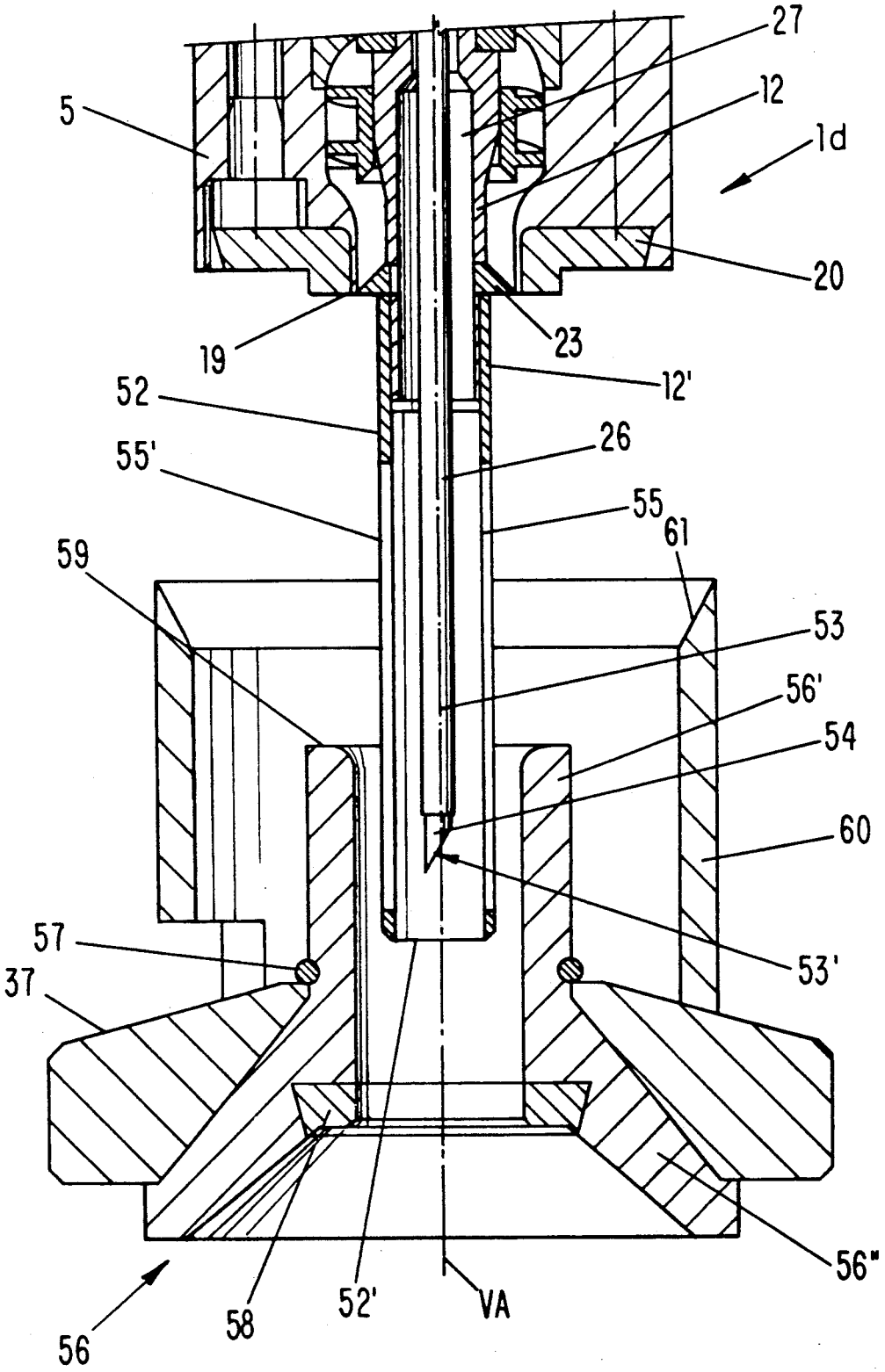
FIG. 5 is a partial view of another exemplary embodiment of the inventive filling element.

FIG. 5 shows a filling element 1*d* that largely corresponds to the filling element 1*a* of FIG. 2, so that those parts of the filling element 1*d* that correspond to parts of the filling element 1*a* have the same reference numerals as those used in The filling element 1*d* differs from the filling element la in that at the underside of the deflector means 23, at the portion 12' of the return gas tube 12 that is disposed at that location, there is secured the upper end of a probe element, i.e. a tubular member or sleeve 52 that is open at both ends and that concentrically surrounds not only the filling element axis VA but also a probe element 53 that is coaxially disposed relative to the filling element axis VA. The sleeve 52 is made of an electrically conductive material, i.e. of corrosion-resistant metal. In the same manner as described in conjunction with the probe 26, the rod-like probe element 53 is provided or held in the filling element 1*d*, and in particular also has a lower length that projects downwardly out of the gas channel 27 and beyond the deflector means 23. The probe element 53 essentially comprises an electrode or rod 54 that is made of electrically conducting material, preferably corrosion-resistant metal, which is covered with an electrically insulating material. The bottom end of the probe element 53 is disposed within the sleeve 52 and is spaced above the lower open end 52' of the sleeve 52. The covering of electrically insulating material is missing from the lower end of the probe element 53; in other words, at this location the inclined end of the rod 54 is exposed and forms the active probe region 53' of the probe element 53. The surface of the sleeve 52 is provided with a number of openings, and in particular in the illustrated embodiment with two elongated slots 55, 55' that extend parallel to the filling element axis VA and are offset relative to one another about this axis by 180°.

In the embodiment of the filling element 1*d* the sleeve 52 and the probe element 53 form the electrical probe that determines the filling height, i.e. the sleeve 52 and the rod 54 are disposed in an either-or control circuit that is then closed by the sleeve 52 and the rod 54 and effects the termination of the filling process when during filling of a bottle 21 the level of the filling material that is rising in the bottle has reached the probe region 53'. An equalization of the filling material level within and outside of the sleeve 52 is possible via the slots 55. Furthermore, gas that is displaced during the process of filling a bottle 21 can flow through the slots 55 and into the sleeve 52, and from there can flow into the gas channel 27. By means of a probe formed from the sleeve 52 and the probe element 53, even when foam is formed by the liquid material, an exact and reproducible response of the probe, and hence an exact closing of the liquid flow valve 14, is ensured when the desired filling height is achieved.

In the illustrated embodiment, the sleeve 52 is connected via the housing 5 of the filling element 1*d* to the positive pole of a power source, while the rod 54, via at least one control element, is connected to the negative pole of the power source.

In place of the probe element 53 that is formed by the rod 54 with its covering of insulating material, it is also possible to provide a rod-like probe element that is made of an insulating material and merely at its active probe region is provided with an exposed electrode that is made of electrically conductive material and that is then connected to a conductor that leads upwardly within the probe element. Furthermore, it is also possible to provide a number of electrodes on the probe element that are electrically insulated from one another.

Figure 6:
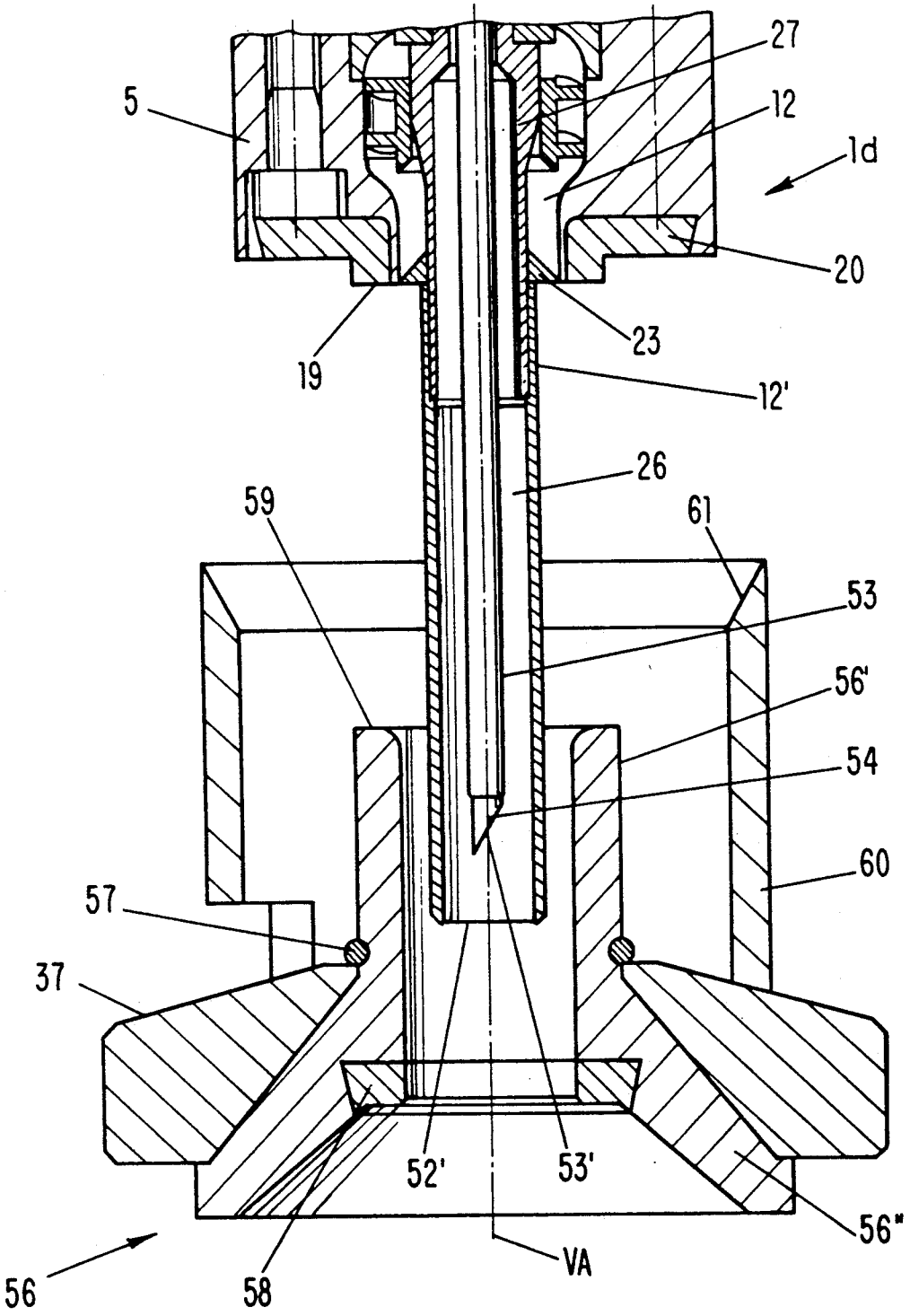
FIG. 6 shows the embodiment of FIG. 5 modified such that instead of slots in the sleeve, a tubular member of screen or mesh-like material is provided.

In place of the slots 55, the sleeve 52 can also have openings or ports that are differently shaped. In principle, it is also possible, in place of a sleeve 52, to utilize a cylinder or sleeve-like element that is made of a screen or mesh material and forms an exposed electrode, at least in the vicinity of the probe region 53' (FIG. 6).

Finally, it is also possible, in place of the sleeve 52 that surrounds the entire periphery of the probe element 53, to provide a trough-like element, the axis of which extends parallel to the filling element axis VA, with this element only partially surrounding the probe element 53. This trough-like element then corresponds, for example, to half of the sleeve 52, assuming the latter to be split in the longitudinal direction.

The filling element 1*d* is also provided with the centering tulip or bell 37, which is guided in such a way as to be displaceable on the housing 5 in the direction of the filling element axis VA. Provided in this centering bell 37 is a plastic insert 56 that has an upper, essentially hollow cylindrical portion 56' with a circular inner and outer cross-sectional configuration, as well as a portion 56'' that adjoins the bottom of the portion 56'; both the outer cross-section as well as the inner cross-section of this lower portion 56'' widen downwardly in a funnel-like or frusto-conical manner. By means of the outer surface of the portion 56'', the insert 56 is held in the similarly frusto-conical recess of the centering bell 37, with the portion 56' projecting beyond the upper side of the centering bell. By means of a securing ring 57, the insert 56 is prevented from falling out of the centering bell 37. Disposed at the transition zone between the upwardly open interior of the portion 56' and the downwardly open interior of the portion 56'', a sealing ring 58 that forms a container seal is disposed in the interior of the insert 56.

During the process of filling a bottle 21, this bottle, together with the centering bell 37, are raised to such an extent that on the one hand the mouth 22 of the bottle 21 rests in a sealing position against the sealing ring 58, and on the other hand the upper opening of the insert 56, i.e. an annular surface 59 thereof at this location, rests in a seating position against the sealing means 20. The hollow cylindrical portion 56', the inner surface of which is concentrically spaced around the sleeve 52, then forms, when the liquid flow valve 14 is opened, an extension of the liquid path between the discharge opening 19 of the filling element 1*d* and the mouth 22 of the bottle 21, with this extension of the liquid path being sealed relative to the atmosphere.

This insert 56, which is rotationally symmetrical to an axis of symmetry that is essentially coaxial with the filling element axis VA, finally determines how far the probe, which is formed by the sleeve 52 and the probe element 53, extends through the mouth 22 and into the interior of a bottle 21 during a filling process. Thus, the insert 56 also determines the filling height for the liquid material in the respective bottle 21. Via the selective use of inserts 56 having various axial lengths of the portion 56' thereof, the filling heights achieved during the filling process can be altered and the filling element 1*d*, as well as the other, identical filling elements 1*d* of a filling machine, can be adapted to various bottle sizes, and in particular without having to replace the sleeve 52 and/or having to replace or adjust the probe element. A rapid removal and securement of the respective insert 56 is possible via the securing ring 57.

To be able to exactly center the centering bell 37, and in particular also the insert 56, relative to the housing 5, i.e. the filling element axis VA, during the process of filling a bottle 21, a centering ring 60 is provided on the centering bell 37 that projects not only beyond the upper side of the centering bell but also upwardly beyond the annular surface 59 of the insert 56. The centering ring 60, which is concentrically spaced around the portion 56', is provided in the vicinity of its upper rim, on the inner side, with a chamfered portion 61 that forms an upwardly frustoconically expanding upper portion of the opening of the centering ring 60. The centering ring 60 cooperates with a circular cylindrical centering portion on the housing 5 that concentrically surrounds the filling element axis VA. This centering portion of the housing 5 is formed by a circular cylindrical lower portion of the housing. The inner diameter of the centering ring 60 below the portion 61 thereof is in this connection somewhat greater than the outer diameter of this lower, circular cylindrical portion of the housing 5.

It is to be understood that variations or modifications of the aforementioned specific embodiments are possible while still remaining within the scope of the present invention. In particular, the probe, which is formed by the probe element 53 and the sleeve 52 or some other probe element that corresponds to this sleeve, can also be used with filling elements for counter-pressure filling machines.

The present invention is, of course, in no way restricted to the specific disclosure of the specification and drawings, but also encompasses any modifications within the scope of the appended claims.

What we claim is:

1. A filling element for filling machines for dispensing a liquid material into containers, including: a valve seat, a liquid flow valve that is disposed in liquid passage means of said filling element and has a valve body that cooperates with said valve seat of said filling element and can be moved back and forth between a position that closes said liquid flow valve off and a position that opens said liquid flow valve; and a discharge opening that is provided on an underside of said filling element a via which, when said liquid flow valve is opened, said liquid material flows to a respective container that is to be filled; said filling element further comprising:

a gas channel that at said underside of said filling element is open to form a return gas opening for a return gas stream, whereby in this region said gas channel is concentric to a filling element axis and is surrounded by said discharge opening of said filling element; and an electrical probe for determining filling heights of said liquid material in said containers, said probe including: a first probe element, which projects beyond said underside of said filling element and has at least one portion that is provided with at least one electrode that forms a probe contact, and a second probe element that is provided on said filling element, extends in the direction of said filling element axis, and at least partially surrounds said at least one portion of said first probe element, with a lower end of said second probe element being spaced further from said underside of said filling element than is said at least one portion of said first probe element, and with said second probe element not only being axially open at said lower end thereof but also having a radially open portion in at least one side portion thereof.

2. A filling element according to claim 1, in which said valve body is movable back and forth in said filling element axis and to open said liquid flow valve, is movable in a direction toward said underside of said filling element: and which further includes: a return gas tube that is concentric to said filling element axis and is surrounded by said discharge opening of said filling element, with said return gas tube having a portion that extends beyond said underside of said filling element, and with said gas channel being formed in said return gas tube and opening out at said tube portion thereof, with said gas channel having a cross-sectional area, at least in said tube portion, such that a flow velocity of return gas therein is reduced to such an extent that none of said liquid material is carried along therewith; and an umbrella-shaped deflector means that is moved along with said valve body during opening and closing of said liquid flow valve, with said deflector means being disposed downstream of said liquid flow valve when viewed in the direction of flow of said liquid material, and with said deflector means, in said closed position of said liquid flow valve, closing off said discharge opening of said filling element at least to such an extent that none of said liquid material can escape through said discharge opening.

3. A filling element according to claim 2, in which said umbrella-shaped deflector means is disposed on said second probe element.

4. A filling element according to claim 1, in which said second probe element includes an electrode.

5. A filling element according to claim 4, in which said second probe element is made of an electrically conductive material.

6. A filling element according to claim 4, in which said at least one electrode of said first probe element has a different electrical potential from that of said electrode of said second probe element.

7. A filling element according to claim 6, in which said electrode of said second probe element has a positive electrical potential relative to said at least one electrode of said first probe element.

8. A filling element according to claim 1, in which said second probe element is a tubular member, and said radially open portion thereof is formed by at least one opening in said tubular member.

9. A filling element according to claim 8, in which said at least one opening is a slot that extends in the direction of the filling element axis.

10. A filling element according to claim 1, in which said radially open portion of said second probe element is formed in that said second probe element surrounds only a portion of the periphery of said first probe element.

11. A filling element according to claim 1, in which said at least one probe portion of said first probe element has at least two electrodes that each form a probe contact and are electrically separate from one another.

12. A filling element according to claim 1, in which said filling element includes a housing, and which includes a centering bell that is disposed on said housing of said filling element in such a way as to be displaceable in the direction of said filling element axis, with said centering bell being provided with an insert that includes an essentially hollow cylindrical first portion that is open at both ends and is concentrically spaced about said probe, with that end of said first portion of said insert that projects beyond an upper side of said centering bell that faces said underside of said filling element forming an annular surface for engagement with a sealing means that is provided on said underside of said filling element and surrounds said discharge opening thereof; and in which a container seal is provided on said insert, with said container seal serving for the engagement of a mouth of a container that is to be filled and surrounding an opening of said first portion of said insert remote from said filling element housing.

13. A filling element according to claim 12, in which said insert, in the vicinity of said container seal, includes a second portion that surrounds said seal and widens in a downward direction away from said first portion of said insert.

14. A filling element according to claim 13, in which said centering bell includes an opening, and which includes a securing ring for holding said insert in said opening of said centering bell.

15. A filling element according to claim 1, in which said filling element includes a housing, and which includes a centering bell, a centering ring that is provided on said centering ball, and a cooperating surface that is provided on said housing of said filling element.

16. A filling element according to claim 1, in which said second probe element is a tubular member, and said radially open portion thereof is formed by screen or mesh material of said second probe element.

* * * * *